US006506039B1

(12) United States Patent
Osumimoto et al.

(10) Patent No.: US 6,506,039 B1
(45) Date of Patent: Jan. 14, 2003

(54) SCREW COMPRESSOR

(75) Inventors: Hiroki Osumimoto, Shimizu (JP); Shigekazu Nozawa, Shimizu (JP); Masayuki Urashin, Shimizu (JP); Takeshi Hida, Shimizu (JP); Hirotaka Kameya, Tsuchiura (JP); Atsushi Watanabe, Chiyoda (JP)

(73) Assignee: Hitachi, Ltd., Tokyo (JP); trustee, for the benefit of Hitachi Air Conditioning System Co., Ltd.

( * ) Notice: Subject to any disclaimer, the term of this patent is extended or adjusted under 35 U.S.C. 154(b) by 0 days.

(21) Appl. No.: 09/996,824

(22) Filed: Nov. 30, 2001

(30) Foreign Application Priority Data

Jul. 30, 2001 (JP) ..... 2001-228845

(51) Int. Cl.[7] ..... F04C 18/26

(52) U.S. Cl. ..... 418/201.1; 418/DIG. 1; 55/459.1; 55/423; 55/467; 55/DIG. 17

(58) Field of Search ..... 418/201.1, DIG. 1; 55/459.1, 467, 423, DIG. 17

(56) References Cited

U.S. PATENT DOCUMENTS

| | | | | | |
|---|---|---|---|---|---|
| 441,995 | A | * | 12/1890 | Wheeler | 55/459.1 |
| 1,505,743 | A | * | 8/1924 | Stebbins | 55/459.1 |
| 4,506,523 | A | * | 3/1985 | DiCarlo et al. | 55/459.1 |

FOREIGN PATENT DOCUMENTS

| | | | | | |
|---|---|---|---|---|---|
| JP | 55025529 | A | * | 2/1980 | F04C/29/02 |
| JP | 55117092 | A | * | 9/1980 | F04C/29/02 |
| JP | 04132891 | A | * | 5/1992 | F04C/18/16 |
| JP | 04153596 | A | * | 5/1992 | F04C/29/02 |
| JP | A-7-243391 | | | 9/1995 | |

* cited by examiner

*Primary Examiner*—Thomas Denion
*Assistant Examiner*—Theresa Trieu
(74) *Attorney, Agent, or Firm*—Antonelli, Terry, Stout, & Kraus, LLP.

(57) ABSTRACT

The screw compressor according to the invention is provided with a main casing 1 having male and female rotors 6, a discharge casing 3 having a discharge passage 15 for compressed gas discharged from the rotors, and an oil reservoir 19 for accumulating oil separated from the compressed gas. The discharge casing is provided with a cylindrical oil separating space section 4 formed therein so as to communicate with the discharge passage, which discharge passage is connected in a tangential direction of the oil separating space section. Further, a discharge port 14 is provided so as to communicate with the oil separating space section, and a cylindrical member 5 is further provided in the oil separating space section so as to be concentric therewith. The oil separating space section and the oil reservoir are connected to each other through a communication passage having a cross-sectional area smaller than that of the oil separating space section.

11 Claims, 5 Drawing Sheets

SCREW COMPRESSOR

BACKGROUND OF THE INVENTION

1. Field of the Invention

The present invention relates to a screw compressor and, more particularly, to a screw compressor used for a refrigeration cycle, which is well suited for decreasing the oil outflow amount (the amount of oil flowing out of the compressor).

2. Description of the Prior Art

There has been known an oil separator in which oil contained in gas discharged from a compressing mechanism section is separated and recovered by the centrifuging.operation, as is disclosed in JP-A-7-243391, for example. This type of oil separator is called as a cyclone type oil separator. The cyclone type oil separator is configured so as to introduce gas discharged from a compressor into a cyclone type of oil separating space section provided above an oil reservoir, where the oil is separated firstly by using the centrifugal force, and thereafter fine oil mist is separated secondarily in an oil collection chamber.

In the centrifugal separation type oil separator, the oil separating space section and the oil reservoir are generally constructed integrally. The oil is put on a wall surface by the centrifugal force induced by a whirling flow in the oil separating space section, drops along the inside wall while whirling, and is accumulated in the oil reservoir provided below the oil separating space section. The gas is discharged to the outside through a discharge pipe communicated with the oil separating space section.

BRIEF SUMMARY OF THE INVENTION

In the above centrifugal separation type of oil separator, since the oil separating space section and the oil reservoir are constructed integrally, it is necessary to increase the distance between an oil surface in the oil reservoir and an inlet of the discharge pipe (hereinafter referred to as a space distance above the oil surface) in order to for ensure the high separation efficiency, and thus, it has been difficult to decrease the size of the oil separator. On the contrary, in the case of decreasing the size of the oil separator, it is necessary to decrease the space distance above the oil surface for securing a necessary amount of oil to be retained. As a result, there has been a drawback that the oil outflow amount increases remarkably by a whirling flow produced by the suction of the gas into the discharge pipe.

Further, in the above conventional oil separator, since the whirling flow in the oil separating space section causes the remarkable fluctuation of the oil level, there has been a problem that it is difficult to control the quantity of the residual oil in the compressor by using an oil level visual observation means such as a sight glass.

It is an object of the present invention to provide a screw compressor capable of decreasing the oil outflow amount (the amount of oil flowing out of the compressor) by adopting a small and simple construction.

It is a further object of the present invention to provide a screw compressor provided with an oil separator well suited for visually observing the oil level of the residual oil in the compressor.

In order to achieve the above objects, according to one aspect of the present invention, there is provided a screw including: a pair of male and female screw rotors which mesh with each other; a bearing for supporting the rotors; a motor for driving the rotors; a casing for housing the rotors, the bearing and the motor; a discharge passage through which refrigerant gas compressed by the screw rotors is discharged; an oil separating space section communicated with the discharge passage; an oil reservoir for accumulating oil separated in the oil separating space section; and a discharge port provided so as to communicate with the oil separating space section for discharging the gas from which the oil is separated in the oil separating space section, wherein the oil separating space section is of a cylindrical shape; the discharge passage is connected to the cylindrical oil separating space section substantially in the tangential direction; and the lower part of the oil separating space section is connected to the oil reservoir through a communication passage having a passage area smaller than the cross-sectional area of the oil separating space section.

Preferably, a cylindrical member concentric with the oil separating space section may be provided so that the discharge port is communicated with the inside space of the.cylindrical member, and the discharge passage may be communicated with a space between the inside wall of the cylindrical oil separating space section and the cylindrical member.

According to further aspect of the present invention, there is also provided a screw compressor including: a male rotor and a female rotor which mesh with each other; a discharge passage for compressed gas to be discharged from the male and female rotors; an oil separating space section for separating oil from the compressed gas discharged from the discharge passage; an oil reservoir for accumulating the separated oil; and a casing for housing the male and female rotors, the discharge passage, the oil separating space section, and the oil reservoir, wherein the oil separating space section is of a cylindrical shape; a discharge port is provided at the upper part of the oil separating space section for introducing the gas to the outside thereof; the oil separating space section is provided with a cylindrical member concentric therewith so that the discharge port communicates with the inside space of the cylindrical member; the discharge passage is connected to the cylindrical oil separating space section in the tangential direction; and the oil separating space section and the oil reservoir are connected to each other through a communication passage having a cross-sectional area smaller than that of the cylindrical portion of the oil separating space section.

According to another aspect of the present invention, there is further provided a screw compressor including: a main casing for housing a male rotor and a female rotor which mesh with each other, a bearing, and a motor; a discharge casing having a discharge passage through which refrigerant gas compressed by the male and female rotors is discharged, an oil separating space section communicated with the discharge passage, and a discharge port; and an oil reservoir provided at the lower part of the oil separating space section, wherein the oil separating space section provided in the discharge casing is of a cylindrical shape; the cylindrical oil separating space section is provided with a cylindrical member concentric therewith so that the discharge port communicates with the inside space of the cylindrical member; the discharge passage has an opening configured so that the refrigerant gas flows along the inside wall surface of the cylindrical oil separating space section; and the screw compressor further comprises a communication passage through which the lower part of the oil separating space section and the oil reservoir are connected to each other, the communication passage being configured so as to have a passage area smaller than the cross-sectional area of the cylindrical portion of the oil separating space section.

Preferably, the oil reservoir may be formed integrally with the main casing in the lower part of the main casing. Also, the communication passage for communicating the oil separating space section with the oil reservoir may be provided at the lower end of the oil separating space section. Further, the bottom part of the oil separating space section may be formed into a substantially conical shape or configured to have a substantially spherical curve. In the case that the bottom part of the oil separating space section is formed into a conical shape, a spiral groove may be provided on the inside wall of the conical oil separating space section. Furthermore, the oil reservoir may be provided with a device for visually observing or detecting the oil level in the oil reservoir, such as a sight glass.

In order to miniaturize the compressor and achieve the sufficient oil separation effect, the volume of the oil separating space section may be 0.015 to 0.020% of the compressor discharge quantity per hour.

An embodiment of the present invention will now be described with reference to the accompanying drawings.

DETAILED DESCRIPTION OF THE INVENTION

Figure 1:
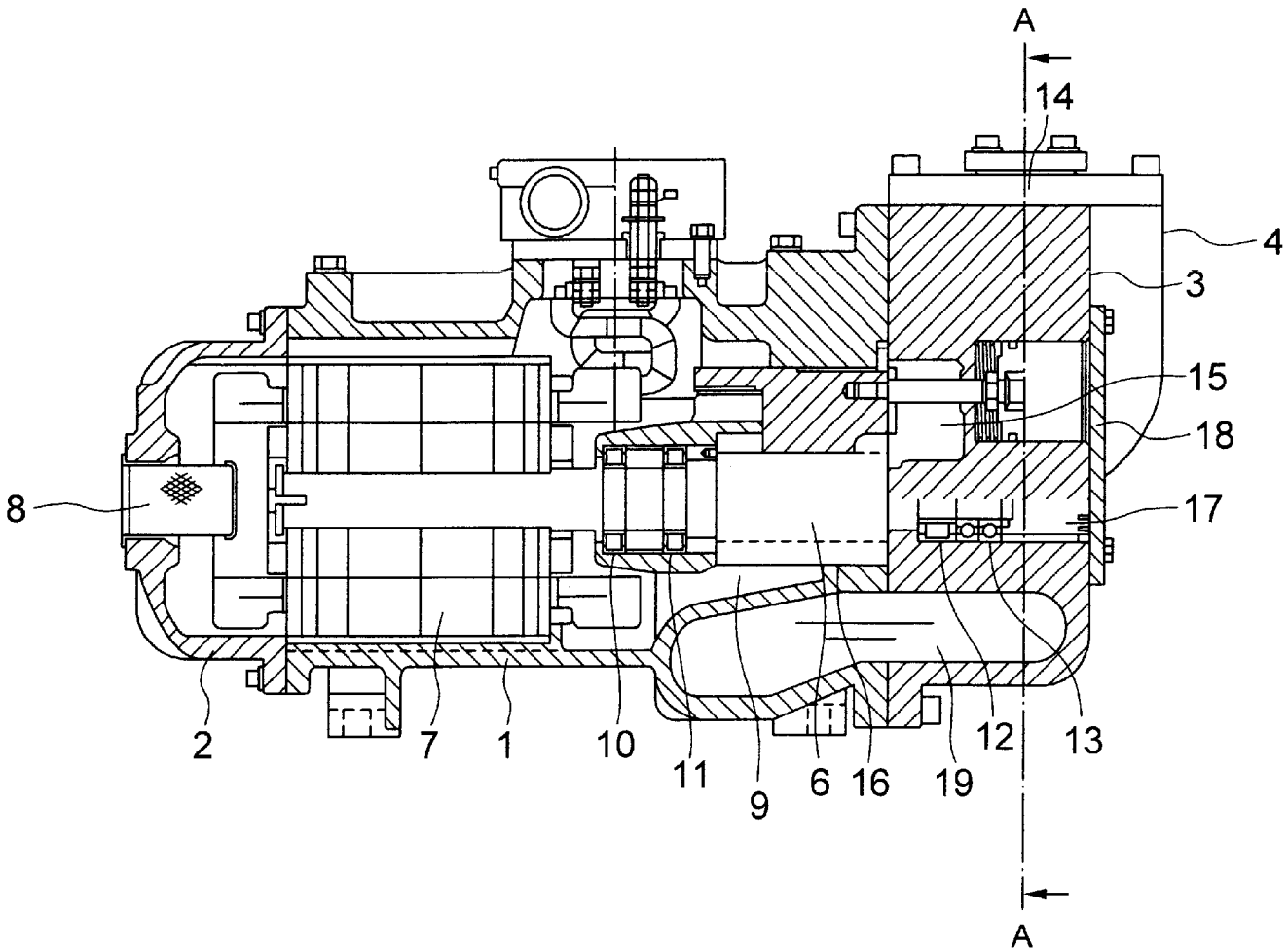
FIG. 1 is a longitudinal sectional view showing the whole structure of a screw compressor in accordance with one embodiment of the present invention.
Figure 2A:
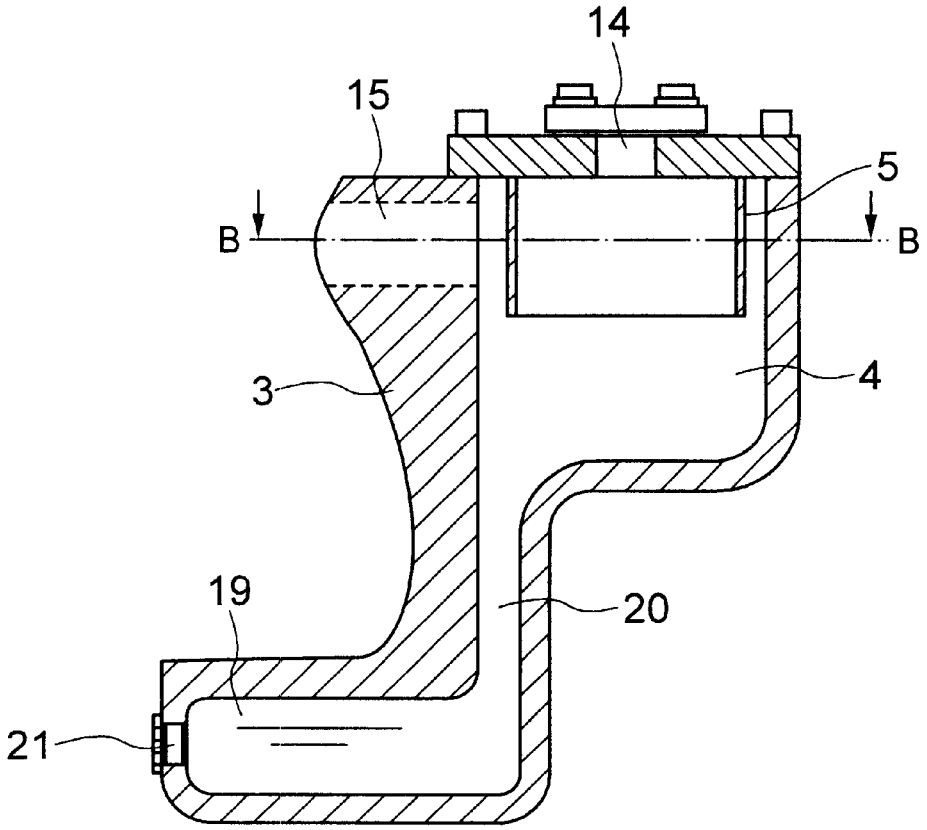
FIG. 2A is a sectional view taken along a line A—A in FIG. 1 for showing the detail of an oil separating space section and an oil reservoir of the screw compressor.
Figure 2B:
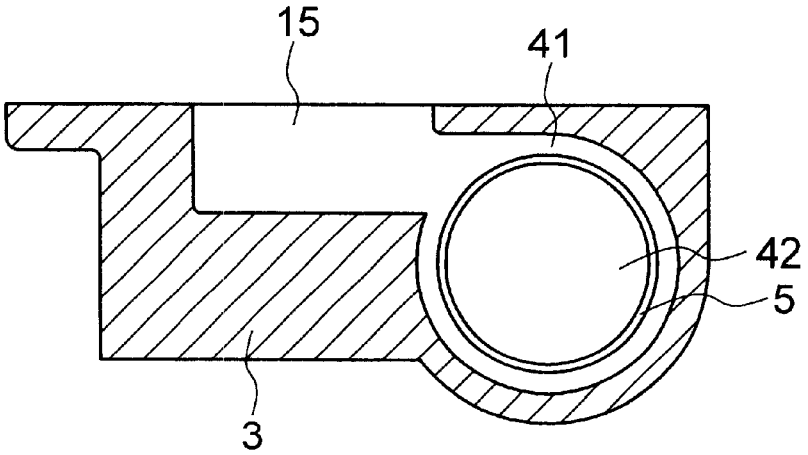
FIG. 2B is a sectional view taken along a line B—B in FIG. 2A.

FIG. 1 is a longitudinal sectional view showing the whole structure of a screw compressor in accordance with one embodiment of the present invention, FIG. 2A is a sectional view taken along a line A—A in FIG. 1 for showing the detail of an oil separating space section and an oil reservoir of the screw compressor, and FIG. 2B is a sectional view taken along a line B—B in FIG. 2A.

The screw compressor includes screw rotors 6 consisting of a male rotor and a female rotor, roller bearings 10, 11 and 12 and a ball bearing 13 for rotationally supporting the rotors 6, a main casing 1 for housing a drive motor 7 and the rotors 6, a motor cover 2 having a suction port 8, a discharge casing 3 in which a discharge passage 15 and an oil separating space section 4 are formed, and a discharge port 14 communicating with the oil separating space section 4.

The main casing 1 is provided with a cylindrical bore 16 for accommodating the screw rotors 6, a suction port 9 for introducing gas sucked through the suction port 8 into the cylindrical bore 16, and the like, which are formed in the main casing 1. Also, a rotor shaft of either one of the pair of male and female screw rotors is connected directly to the motor 7.

Refrigerant gas compressed by the rotors 6 is discharged into a discharge space (oil separating space section) 4 formed in the discharge casing 3 through the discharge passage 15. The discharge passage 15 is configured so as to be connected to the cylindrical oil separating space section 4 in the tangential direction thereof, so that the refrigerant gas, after passing through the discharge passage 15, flows along the surface of the inside wall of the cylindrical oil separating space section 4. The discharge casing 3 is fixed to the main casing 1 by bolts or other means. At one end of the discharge casing 3, a shield plate 18 is installed to close a bearing chamber 17 accommodating the roller bearing 12 and the ball bearing 13. An oil reservoir 19 is formed in the lower part of the discharge casing 3 and in the lower part on the discharge side of the main casing 1, so that the oil accumulated in the oil reservoir 19 is supplied to each of the bearing sections through oil supply passages formed in the main casing 1 and the discharge casing 3.

The oil separating space section 4 and the oil reservoir 19 are connected to each other through a communication passage 20 having a cross-sectional area smaller than that of the oil separating space section 4.

As shown in FIG. 2A, the discharge space 4 is formed into a cylindrical shape, and a cylindrical member 5 of a tubular shape is disposed so as to be concentric with the cylindrical discharge space 4. This cylindrical member 5 is provided so as to extend substantially to a central position in the vertical direction of the discharge space 4. Further, the discharge port 14 is provided at the upper part of the discharge casing 3 so as to communicate with the cylindrical member 5.

The following is a description of the flow of the refrigerant gas and oil.

The low-temperature and low-pressure refrigerant gas sucked through the suction port 8 provided in the motor cover 2 passes through a gas passage between the motor 7 and the main casing 1, and through an air gap between a stator and a motor rotor. Then, after cooling the motor 7, the gas is sucked through the suction port 9 formed in the main casing 1 into a compression chamber formed by meshing tooth flanks of a male and female screw rotor and the main casing 1. Subsequently, the refrigerant gas is compressed gradually by the decrease in volume of the compression chamber, thereby turning to the high-temperature and high-pressure gas. Finally, the refrigerant gas is discharged into the discharge space (oil separating space section) 4 through the discharge passage 15.

The volume of the oil separating space section 4 is set so as to be 0.015 to 0.020% of the compressor discharge quantity per hour. Such volume can provide a smaller-size compressor and a sufficient oil separation effect. The volume ratio of the oil separating space section to the compressor discharge quantity may be adjusted appropriately according to the operating condition of the compressor, the kinds of refrigeration medium, the kinds of oil, and the like.

The roller bearings 10, 11 and 12 bear the radial load of the compression reaction force acting on the male and female screw rotors at the time of the compression, and the ball bearing 13 bears the thrust load thereof. The oil for lubricating and cooling these bearings is fed from the high-pressure oil reservoir 19 provided at the lower part of a compressing mechanism section to the compression chamber through an oil passage communicating with each of the bearings by the pressure difference therebetween.

Subsequently, the oil is discharged into the oil separating space section 4 together with the compressed gas, and then returns to the oil reservoir 19.

The discharge space 4 is divided into an outside space 41 and an inside space 42 by the cylindrical member 5 provided concentrically. The discharge passage 15 opens in the substantially tangential direction of the inside wall of the oil separating space section 4. The mixture of gas and oil discharged from the discharge passage 15 is discharged into the outside space 41 in the tangential direction of the inside wall of the cylindrical discharge space and flows along the cylindrical inside wall. Thereby, a whirling flow is developed, so that the oil contained in the refrigerant gas is blown toward the outside by the centrifugal force, and sticks onto the inside wall, whereby the oil is separated from the gas. The separated oil goes down along the cylindrical inside wall, passes through the communication passage 20 communicating the oil separating space section 4 with the oil reservoir 19; and is accumulated in the oil reservoir 19 below the oil separating space section 4. The communication passage 20 may be formed by a tube, for example. The whirling flow in the oil separating space section 4 causes the re-scattering which may bring away the separated oil again, however, because the separated oil is recovered into the oil reservoir 19 through the communication passage having a small passage area, the oil can be prevented from being brought away by the flow of the gas in the separation space.

After the oil is separated, the compressed refrigerant gas flows into the inside space 42 in the cylindrical member 5, and is discharged to the outside of the compressor through the discharge port 14.

The oil reservoir 19 is filled with the separated oil, and the gas does not flow into the oil reservoir 19, so that the oil in the oil reservoir 19 is not affected by the whirling flow generated in the oil separating space section 4. Thereby, the oil surface in the oil reservoir 19 can be kept in a still state. Accordingly, it is possible to visually observe the oil level in the oil reservoir 19 by providing a sight glass 21 or other oil level visual observation means in at least one location near the lower end of the oil reservoir 19, so as to provide a means for avoiding the shortage of oil supplied to the compressor.

Next, other examples of the oil separating space section 4 will be described with reference to FIGS. 3 to 5.

Figure 3A:
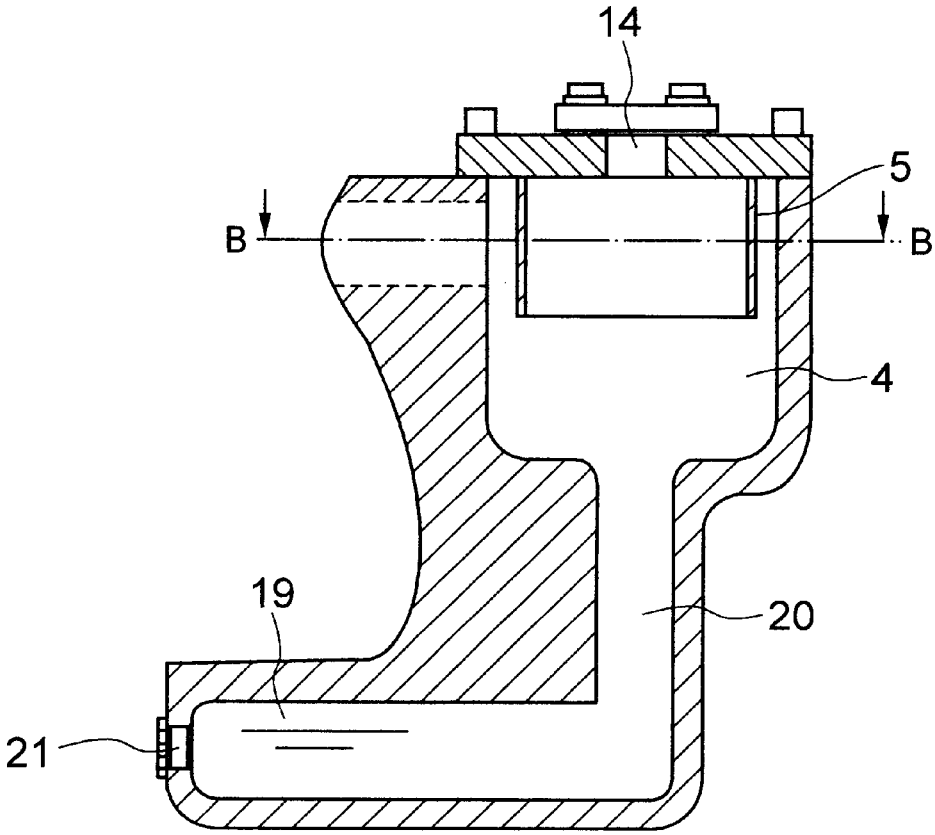
FIGS. 3A and 3B are sectional views corresponding to FIGS. 2A and 2B for showing further embodiment of an oil separating space section and an oil reservoir of the screw compressor shown in FIG. 1.
Figure 3B:
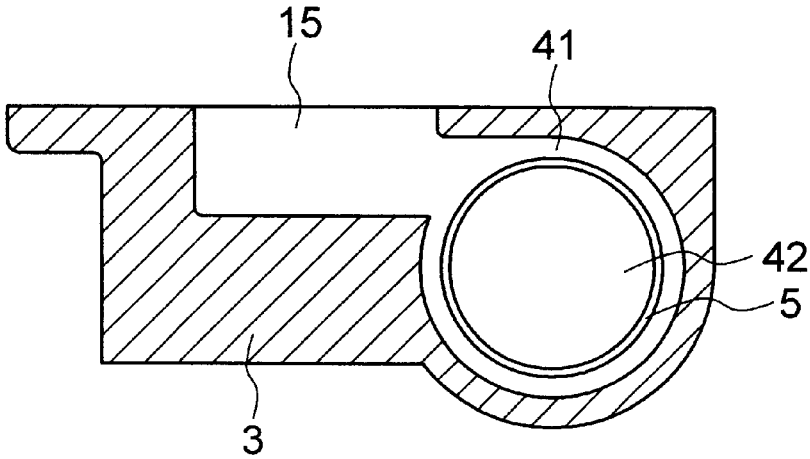

FIGS. 3A and 3B show an example in which the communication passage 20 for connecting the oil separating space section 4 to the oil reservoir 19 is disposed in the vicinity of the center of the lower end of the oil separating space section 4.

Figure 4A:
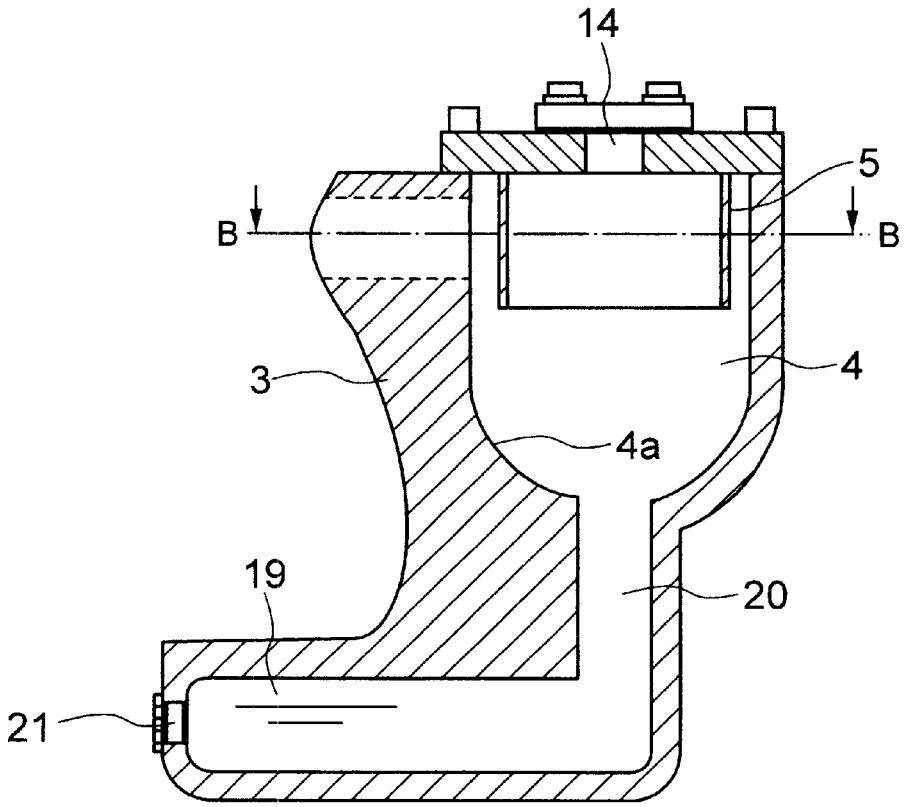
FIGS. 4A and 4B are sectional views corresponding to FIGS. 2A and 2B for showing still further embodiment of an oil separating space section and an oil reservoir of the screw compressor shown in FIG. 1.
Figure 4B:
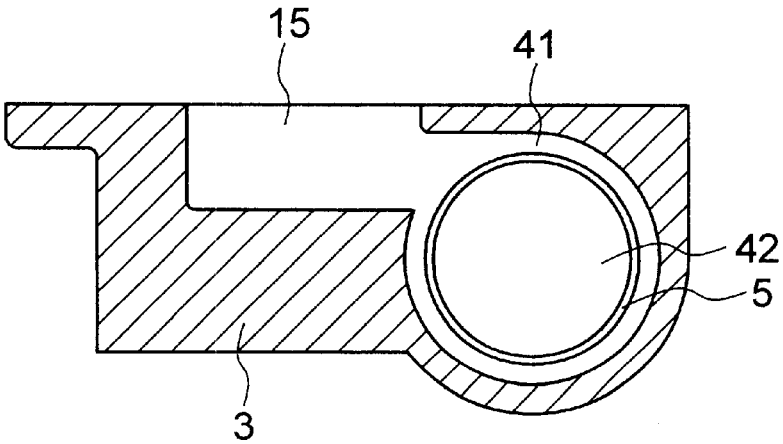

In an example shown in FIGS. 4A and 4B, the lower part of the wall portion of the oil separating space section 4 is formed into a substantially spherical curved portion 4*a*. The oil subjected to the centrifugal separation caused by the whirling flow flows downward on the wall surface of the cylinder while flowing in the circumferential direction. According to this example, when oil droplets and/or oil film stick onto the inside wall, the flowing-down velocity of the oil droplets and/or oil film increases until they reach the communication passage 20, so that the oil can be recovered into the oil reservoir 19 efficiently.

Figure 5A:
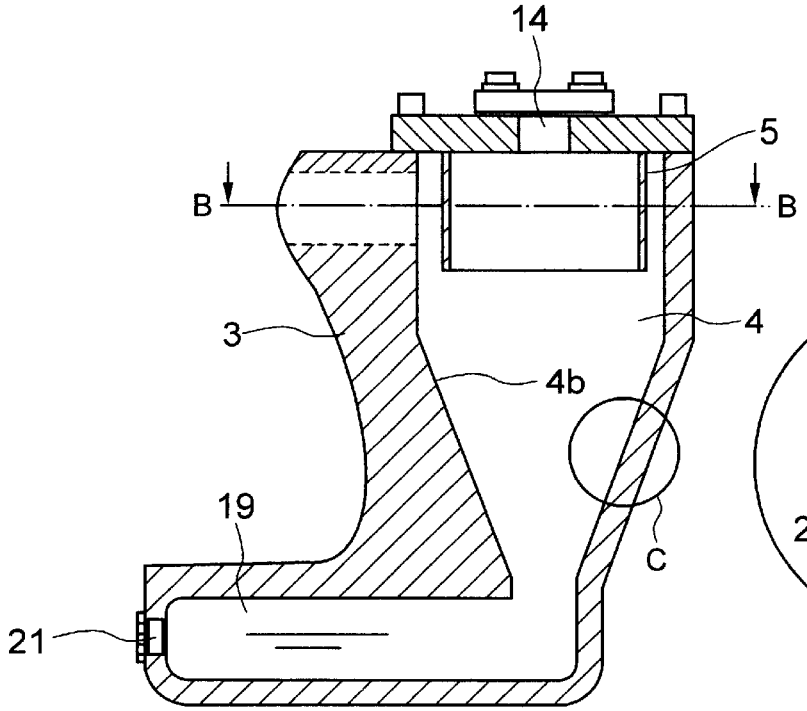
FIGS. 5A and 5B are sectional views corresponding to FIGS. 2A and 2B for showing another embodiment of an oil separating space section and an oil reservoir of the screw compressor shown in FIG. 1.
Figure 5C:
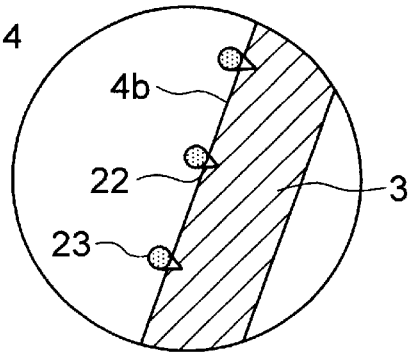
FIG. 5C is an enlarged view of portion C in FIG. 5A.
Figure 5B:
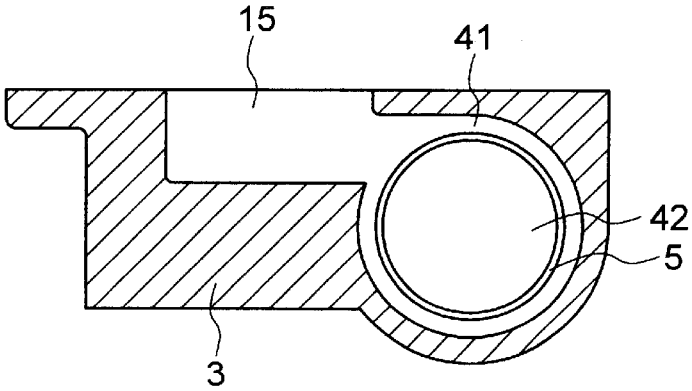

FIGS. 5A and 5B show an example in which the lower part of the wall portion of the oil separating space section 4 is formed into a substantially conical portion 4*b* so that the same effect as that of the example shown in FIGS. 4A and 4B can be produced. Further, in this example, a spiral groove 22 is formed on the inside wall of the conical portion 4*b*. This groove is twisted downward so as to correspond to the flow direction of the whirling flow. Oil droplet 23 and/or oil film stuck onto the wall surface by the centrifugal separation flow into the spiral groove and are caught by the groove, so that the oil on the wall surface can be prevented from being brought away by the whirling flow, that is, the re-scattering of the oil can be avoided. This example also provides an effect that the flowing-down velocity increases, so that the oil can be recovered into the oil reservoir space efficiently.

In the above-described examples, the case that the oil separating space section 4 and the oil reservoir 19 are formed integrally with the casing of the screw compressor has been described, however, instead of integrally forming the oil separating space section 4 with the discharge casing 3, an oil separator which includes a cylindrical oil separating space section, a cylindrical member provided concentrically with the oil separating space section, a discharge port communicating with the oil separating space section and the inside space of cylindrical member, etc. may be provided as a separate member from the compressor casing. In this case, the discharge passage 15 is provided so that the compressed gas which contains the oil and is discharged from the compressor rotors flows into the cylindrical oil separating space section in the tangential direction of the inside wall of oil separating space section. This discharge passage may be formed in the discharge casing 3, or may be formed by using a separate pipe.

Instead of forming the oil reservoir 19 shown in the above-described examples at the lower part of the compressor casing (the main casing and the discharge casing), an oil tank may be provided as a member separate from the compressor casing so as to serve as an oil reservoir. In the case that the oil separating space section and/or the oil reservoir are provided as a separate member, the communication passage 20 for connecting these two elements to each other may be formed by a separate pipe having a cross-sectional area smaller than that of the oil separating space section.

According to the present invention, since the oil separating space section and the oil reservoir are provided separately via the communication passage in the oil separating space section, it is possible to effectively restrain the re-scattering of the oil to the oil separating space section even if the space distance above the oil surface in the oil reservoir is decreased. As a result, the present invention provides an effect that the compressor can be made smaller in size while the oil outflow amount (the amount of oil flowing out of the compressor) is decreased by means of the simple construction.

Further, according to the present invention, since the oil level in the oil reservoir is less liable to be affected by the whirling flow in the oil separating space section, the oil level is stabilized. Thus, it is possible to check the quantity of residual oil in the compressor by providing an oil level visual observation means such as a sight glass, so that the shortage of the oil can be prevented.

What is claimed is:

1. A screw compressor comprising:

a pair of male and female screw rotors which mesh with each other;

a bearing for supporting said rotors;

a motor for driving said rotors;

a casing for housing the rotors, the bearing and the motor;

a discharge passage through which refrigerant gas compressed by said screw rotors is discharged;

an oil separating space section communicated with said discharge passage;

an oil reservoir for storing oil separated in said oil separating space section; and a discharge port provided so as to communicate with said oil separating space section for discharging the gas from which the oil is separated in said oil separating space section, wherein said oil separating space section is of a cylindrical shape, said discharge passage being connected to the cylindrical oil separating space section substantially in the tangential direction, and the lower part of said oil separating space section is connected to said oil reservoir thorough a communication passage having a passage area smaller than the cross-sectional area of said oil separating space section.

2. The screw compressor according to claim 1, wherein said cylindrical oil separating space section is provided with a cylindrical member concentric therewith so that said discharge port communicates with the inside space of the cylindrical member, and said discharge passage communicates with a space between the inside wall of said cylindrical oil separating space section and said cylindrical member.

3. The screw compressor according to claim 1, wherein said oil reservoir is provided with a device for visually observing or detecting the oil level in said oil reservoir.

4. The screw compressor according to claim 1, wherein the bottom part of said oil separating space section is configured to have a substantially spherical curve.

5. The screw compressor according to claim 1, wherein the bottom part of said oil separating space section is formed into a substantially conical shape.

6. The screw compressor according to claim 5, wherein a spiral groove is provided on the inside wall of said conical oil separating space section.

7. The screw compressor according to claim 1, wherein the volume of said oil separating space section is 0.015 to 0.020% of the compressor discharge quantity per hour.

8. A screw compressor comprising:

a male rotor and a female rotor which mesh with each other;

a discharge passage for compressed gas to be discharged from said male and female rotors;

an oil separating space section for separating oil from the compressed gas discharged from said discharge passage;

an oil reservoir for storing the separated oil; and a casing for housing the male and female rotors, the discharge passage, the oil separating space section, and the oil reservoir, wherein said oil separating space section is of a cylindrical shape, a discharge port is provided at the upper part of said oil separating space section for introducing the gas to the outside thereof, said oil separating space section is provided with a cylindrical member concentric therewith so that said discharge port communicates with the inside space of the cylindrical member, said discharge passage is connected to said cylindrical oil separating space section in the tangential direction, and said oil separating space section and said oil reservoir are connected to each other through a communication passage having a cross-sectional area smaller than that of the cylindrical portion of said oil separating space section.

9. The screw compressor according to claim 8, wherein said communication passage for communicating said oil separating space section with said oil reservoir is provided at the lower end of said oil separating space section.

10. A screw compressor comprising:

a main casing for housing a male rotor and a female rotor which mesh with each other, a bearing, and a motor;

a discharge casing having a discharge passage through which refrigerant gas compressed by said male and female rotors is discharged, an oil separating space section communicated with said discharge passage, and a discharge port; and an oil reservoir provided at the lower part of said oil separating space section, wherein said oil separating space section provided in said discharge casing is of a cylindrical shape;

said cylindrical oil separating space section is provided with a cylindrical member concentric therewith so that said discharge port communicates with the inside space of said cylindrical member;

said discharge passage has an opening configured so that the refrigerant gas flows along the inside wall surface of said cylindrical oil separating space section; and the screw compressor further comprises a communication passage through which the lower part of said oil separating space section and said oil reservoir are connected to each other, the communication passage being configured so as to have a passage area smaller than the cross-sectional area of the cylindrical portion of said oil separating space section.

11. The screw compressor according to claim 10, wherein said oil reservoir is formed integrally with said main casing in the lower part of the casing.

* * * * *